United States Patent [19]

Denmark

[11] Patent Number: 4,831,676

[45] Date of Patent: May 23, 1989

[54] DENTAL PROPHYLAXIS DEVICE

[76] Inventor: Stanley J. Denmark, 675 Old Country Rd., Westbury, N.Y. 11050

[21] Appl. No.: 198,171

[22] Filed: May 24, 1988

[51] Int. Cl.[4] ..... B08B 1/00

[52] U.S. Cl. ..... 15/104.93; 15/167.1; 15/210 R; 15/244.3; 128/62 A

[58] Field of Search ..... 15/104.93, 104.94, 167.1, 15/210 R, 244.3, 227; 401/7, 8; 604/1, 2; 128/62 A

[56] References Cited

U.S. PATENT DOCUMENTS

| | | | |
|---|---|---|---|
| 1,820,256 | 8/1931 | Stewart | 15/244.3 |
| 2,165,420 | 7/1939 | Seifert | 15/210 R |
| 2,763,885 | 9/1956 | Lyons | 15/227 X |
| 3,109,192 | 11/1963 | Levenson | 15/167.2 |
| 4,335,731 | 6/1982 | Bora, Jr. | 15/227 X |
| 4,665,901 | 5/1987 | Spector | 128/62 A |

*Primary Examiner*—Peter Feldman

*Attorney, Agent, or Firm*—Bauer & Schaffer

[57] ABSTRACT

A pair of absorbent core members, saturated with dental cleansing material, are enclosed in a spaced-apart disposition within a saturable covering layer having a roughened surface. The core members are flexible but capable of retaining their shape, said core members being the portion of said covering layer between said core members being flexible and indented. The device is insertable in the mouth and moved along the teeth and gums to clean and massage teeth and gums.

15 Claims, 1 Drawing Sheet

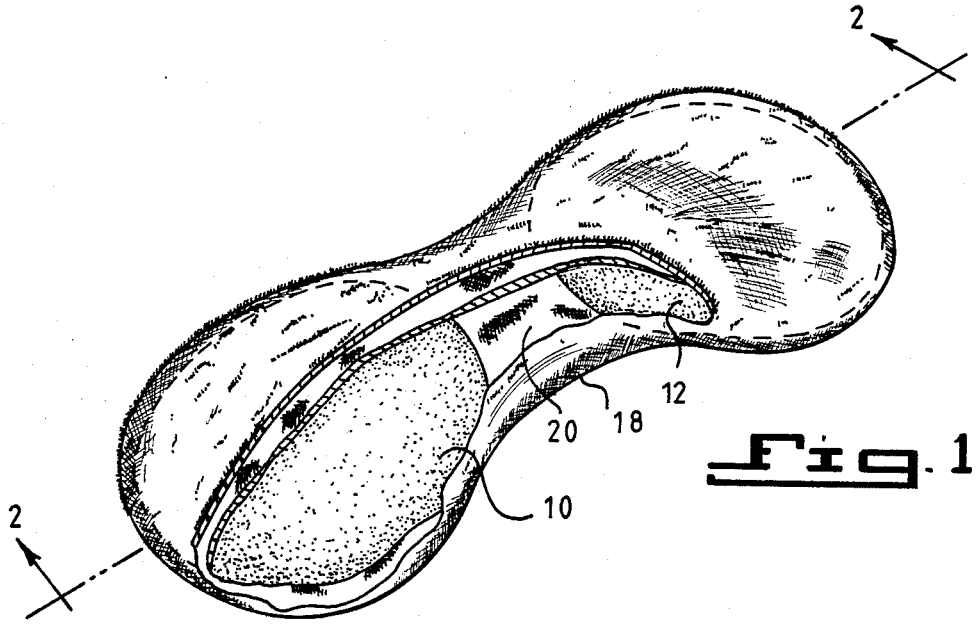
Fig. 1
Fig. 2
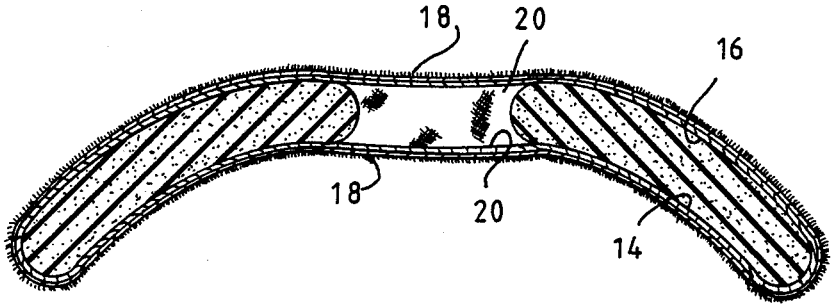
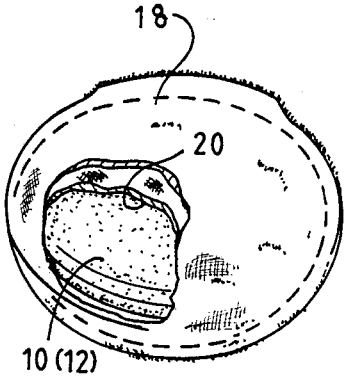
Fig. 3

DENTAL PROPHYLAXIS DEVICE

This invention relates to a dental prophylaxis device. More particularly, the invention relates to a dental prophylaxis device for cleansing the teeth and massaging the gums.

BACKGROUND OF THE INVENTION

Other than conventional brushes, a wide variety of dental prophylaxis devices for cleansing the teeth and massaging the gums as well as applying medication thereto to treat, for example, periodontal disease, are known. Many of these devices contain medication and/or dentrifice as an integral part thereof. Examples of such devices are disclosed in U.S. Pat. Nos. 4,665,901; 4,617,694; 4,335,731; 3,675,264; 3,109,192; 2,999,260; 2,966,691; 2,112,184; and 2,763,885. These devices are generally attachable to one or more fingers for insertions into the mouth and manipulation over the teeth and gums. On the other hand, tooth and/or gum brushes, of a variety of configurations, and some of which have a self-contained supply of medication and/or dentrifice, are also known as may be seen from U.S. Pat. No. 4,399,582; 3,193,864; 2,807,820; British Pat. No. 2,129,675; and German Pat. No. 2,147,727. Still further, a disposable surgical scrub sponge impregnated with detergent is disclosed in U.S. Pat. No. 3,369,419, and a method of producing a sponge impregnated with detergent is disclosed in U.S. Pat. No. 3,112,219, while U.S. Pat. No. 20,057,500 discloses a combination of waxes and polishes.

There still exists, however, a need for an improved device of the above-described type which are of simple constructions, simple to use, and are of a ductile gum and tooth conforming nature. The present invention fulfills such a need.

BRIEF STATEMENT OF THE INVENTION

In accordance with the present invention there is provided a dental prophylaxis device for cleansing the teeth and massaging the gums, comprising a pair of absorbent core members saturated with dental cleansing material and which are flexible but capable of retaining their fixed shape in use. The core members are enclosed in spaced-apart disposition within a saturatable covering layer having a variegated surface, the position of the covering layer of the device between the core member being flexible and indented. The device may be inserted in the mouth and moved along the teeth and gums without interference from the lip muscles to cleanse the teeth while the variegated surface of the covering layer massages the gums.

THE DRAWINGS

In order to understand the invention more fully, reference is directed to the accompanying drawing which is to be taken in conjunction with the detailed description fo the invention as set forth hereinbelow and in which drawing:

FIG. 1 is a partially cross-sectioned perspective view of a dental prophylaxis device of the invention with the saturatable covering layer having a variegated surface and a second layer of soft, strong covering layer next thereto being partially cut away to expose the core members;

FIG. 2 is a partial lateral view in section of the device shown in FIG. 1, taken along line 2—2 of FIG. 1; and FIG. 3 is an end view partially in section of the device shown in FIGS. 1 and 2, taken along line 3 of FIG. 2.

DESCRIPTION OF THE PREFERRED EMBODIMENTS

Referring now more particularly to FIG. 1, the dental prophylaxis device according to the present invention comprises a pair of absorbent core members 10 and 12 which are flexible but capable of retaining their shape and which are saturated completely with a liquid or semi-liquid (i.e. a gel or a cream) cleansing material which may also include an oral deodorant or even medication. Core members 10 and 12 may be made from suitably shaped natural sponge material or sponge-like material which may be made from synthetic, polymeric sponge-like materials or semi-rigid synthetic, polymeric foams such as polyethylene, acrylic, polyester, polyamide, and polyurethane sponges and semi-rigid foams and the like. Moreover, core members 10 and 12 are preferably coin-shaped—that is, generally circular, and are curved (in diametric section) to have concave and convex surfaces 14 and 16, respectively, thus allowing the device of this invention to conform more readily to the shape of the teeth and gums.

The core members 10 and 12 are enclosed in a spaced-apart disposition within a saturatable outer covering layer 18 having a variegated or rough portion of the covering 18 between the core members being flexible and indented so that when the device is inserted in the mouth the labile muscles in the center of the lips do not interfere with the movement of the device over the teeth and gums. Covering layer 18 may be made out of any suitable textile material having a soft but variegated or rough surface. Preferred materials are gauze pile or terry cloth, and the like.

A second and inner layer 20 of soft, strong covering material, which is coextensive in size with the covering layer 18, is disposed between core members 10 and 12 and the covering layer 18. Layer 20 may be made from any soft, strong textile material, with gauze being a preferred material useful to make the same.

The device of the invention can be made in different sizes such as small, medium, and large. In fact, a range of small, medium, and large sizes can be made for children, adults, or even male and female, etc. Those skilled in the art will readily determine the appropriate sizes for each class, without any undue experimentation.

In use, the device is placed flat against the upper or lower gums and teeth and pressed to release the liquid or cream contained in the flexible covers to allow it to exude outwardly from the cores through the covering layer or layers and thence onto the teeth and gums. The user then moves the device across the surfaces of the teeth and gums, thus achieving gum massage, dental cleaning, and mouth deodarizing where a deodorant is included.

The device may be manufactured and placed in sealed, sterile envelopes after it has been rendered sterile so that it may be shipped for distribution and marketing ready for use.

The device of this invention presents numerous advantages. For example, it may be made from readily available materials which are relatively inexpensive. The exudate or exudates may be tasteful or tasteless. The anti-rough surface stimulates and aids in massaging the gums and cleansing the teeth. Moreover, the device being bendable or flexible is capable of applying massaging action and cleansing action to both the inside and outside gum and teeth surfaces, conforming well thereto. In addition, after use it may be thrown away, thus lessening the possibility of reinfecting the gums and teeth which reuseable brushes often tend to do. Numerous other advantages of the device of this invention will be apparent to those skilled in the art.

It is to be understood, therefore, that numerous modifications of the device of this invention may be made without departure from the spirit and scope of the invention, and it is not to be limited to the described embodiments thereof, except as defined in the appended claims.

What is claimed is:

1. A dental prophylaxis device for cleansing the teeth and massaging the gums comprising a pair of absorbent core members, saturated with dental cleansing material, which are flexible but capable of retaining their shape, said core members being enclosed in a spaced-apart disposition within a saturatable covering layer having a variegated surface, the portion of said covering layer of said device between said core members being flexible and indented, whereby said device may be inserted in the mouth and moved along the teeth and gums without interference from the lip muscles to cleanse the teeth while the variegated surface of said covering layer massages the gums.

2. A dental polyphylaxis device according to claim 1 wherein the dental cleansing material is a liquid.

3. A dental prophylaxis device according to claim 1 wherein the dental cleansing material is a semi-liquid.

4. A dental prophylaxis device according to claim 1 wherein the dental cleansing material is a dental cream.

5. A dental prophylaxis device according to claim 1 wherein the dental cleansing material includes an oral deodorant.

6. A dental prophylaxis device according to claim 1 wherein the core members are curved, having a concave surface and a convex surface, whereby the device conforms more readily to the shape of the teeth and the gums.

7. A dental prophylaxis device according to claim 1 wherein the covering layer is terry cloth.

8. A dental prophylaxis device according to claim 1 including a second layer of soft, strong covering material which is disposed between the core members and covering layer having a variegated surface, said second layer being coextensive in size and shape with said covering layer having the variegated surface.

9. A dental prophylaxis device according to claim 8 wherein the second layer is gauze.

10. A dental prophylaxis device according to claim 1 wherein the core members are sponges.

11. A dental prophylaxis device according to claim 1 wherein the core members are made of sponge rubber.

12. A dental prophylaxis device for cleansing the teeth and massaging the gums comprising a pair of generally coin-shaped, absorbent core members having a concave surface and a convex surface and which are flexible but capable of retaining their shape, said core members being saturated with dental cleansing material and enclosed in a spaced-apart disposition within a saturatable covering layer having a variegated surface, the portion of said covering layer between said core members being flexible and indented, whereby said device may be inserted in the mouth and moved along the teeth and gums without interference from the lip muscles to cleanse the teeth while the variegated surface of said covering layer massages the gums.

13. A dental prophylaxis device according to claim 12 wherein the core members are sponges.

14. A dental prophylaxis device according to claim 12 wherein the dental cleansing material is a dental cream which includes an oral deodorant.

15. A dental prophylaxis device according to claim 12 wherein the saturated covering layer is terry cloth.

* * * * *